US012053099B2

(12) United States Patent
Choi

(10) Patent No.: US 12,053,099 B2
(45) Date of Patent: Aug. 6, 2024

(54) FOLDABLE ROCKING CHAIR FRAME AND CHAIR HAVING SAME

(71) Applicant: Campvalley (Xiamen) Co., Ltd., Xiamen (CN)

(72) Inventor: Kwan Jun Choi, Xiamen (CN)

(73) Assignee: Campvalley (Xiamen) Co., Ltd., Xiamen (CN)

( * ) Notice: Subject to any disclaimer, the term of this patent is extended or adjusted under 35 U.S.C. 154(b) by 105 days.

(21) Appl. No.: 17/861,062

(22) Filed: Jul. 8, 2022

(65) Prior Publication Data

US 2023/0036948 A1 Feb. 2, 2023

(30) Foreign Application Priority Data

Jul. 27, 2021 (CN) ..... 202121736178.4
Aug. 31, 2021 (CN) ..... 202122084670.4

(51) Int. Cl.
*A47C 3/02* (2006.01)
*A47C 4/28* (2006.01)

(52) U.S. Cl.
CPC ..... *A47C 3/02* (2013.01); *A47C 4/286* (2013.01)

(58) Field of Classification Search
CPC ..... A47C 3/02; A47C 4/286
See application file for complete search history.

(56) References Cited

U.S. PATENT DOCUMENTS

| | | | |
|---|---|---|---|
| 291,062 | A | 1/1884 | Latour |
| 2,459,843 | A | 1/1949 | Scholander |
| 2,712,349 | A | 7/1955 | Le Voir |
| 3,093,407 | A | 6/1963 | Wilson |
| 4,386,790 | A | 6/1983 | Kassai |
| 4,613,185 | A | 9/1986 | Marchesini |
| 5,356,107 | A | 10/1994 | Sinohuiz |
| 5,501,505 | A | 3/1996 | Jablonski |
| 5,527,089 | A | 6/1996 | Charest |
| 5,620,227 | A | 4/1997 | Brune |
| 5,851,052 | A | 12/1998 | Gustafsson |
| 5,893,605 | A | 4/1999 | Chang |
| 6,082,813 | A | 7/2000 | Chen |
| 6,179,374 | B1 | 1/2001 | Tang |

(Continued)

FOREIGN PATENT DOCUMENTS

| | | | |
|---|---|---|---|
| CN | 201480624 | U | 5/2010 |
| DE | 195 40 528 | A1 | 5/1996 |
| WO | WO 2005/112703 | A1 | 12/2005 |

*Primary Examiner* — Anthony D Barfield

(74) *Attorney, Agent, or Firm* — MORGAN, LEWIS & BOCKIUS LLP

(57) ABSTRACT

A foldable rocking chair frame includes a left side stand and a right side stand. Each stand includes a rocking structure and a plurality of supports interconnected and foldable into each other. The rocking structure includes an arched member, a slider, and one or more links. When the frame is unfolded, the arched member has an end portion disposed at the rear side of the frame and extends from the rear side of the frame toward the front side of the frame. The slider is disposed at the arched member and slidable along the arched member. Each of the one or more links is pivotally connected to the arched member and a support in the plurality of supports. The left and right side stands are connected by a connecting assembly that allows the left and right side stands to fold into each other.

20 Claims, 19 Drawing Sheets

(56) References Cited

U.S. PATENT DOCUMENTS

| | | | | |
|---|---|---|---|---|
| 6,247,749 | B1 | 6/2001 | Yu | |
| 6,302,479 | B1 | 10/2001 | Zheng | |
| 6,322,646 | B1 | 11/2001 | Chakrabarti et al. | |
| 6,454,348 | B1 | 9/2002 | Wu | |
| 6,634,705 | B1 | 10/2003 | Zheng | |
| 6,752,414 | B1 | 6/2004 | Waldron et al. | |
| 6,840,573 | B1 | 1/2005 | Yao | |
| 6,926,356 | B2 | 8/2005 | Chen | |
| 7,011,372 | B1 | 3/2006 | Hsieh | |
| 7,100,975 | B1 * | 9/2006 | Zheng | A47C 4/286 297/32 |
| 7,404,601 | B2 | 7/2008 | Chen | |
| 7,717,502 | B2 | 5/2010 | Deng | |
| 7,717,503 | B1 | 5/2010 | Watson | |
| 7,758,111 | B2 | 7/2010 | Chen | |
| 8,100,469 | B2 | 1/2012 | Lougee | |
| 8,303,032 | B1 | 11/2012 | Platta | |
| 8,465,090 | B1 | 6/2013 | O'Connor | |
| 8,511,747 | B2 | 8/2013 | Lougee | |
| 9,204,729 | B2 | 12/2015 | Frankel | |
| 9,585,481 | B2 | 3/2017 | Choi | |
| 2002/0024240 | A1 | 2/2002 | Chen | |
| 2004/0135405 | A1 | 7/2004 | Zheng | |
| 2006/0249991 | A1 | 11/2006 | Hsieh | |
| 2010/0237665 | A1 | 9/2010 | Grace | |
| 2010/0308042 | A1 | 12/2010 | Faris | |
| 2011/0248037 | A1 | 10/2011 | Fung | |
| 2011/0248040 | A1 | 10/2011 | McGregor | |
| 2011/0303659 | A1 | 12/2011 | Perlman | |
| 2013/0264340 | A1 | 10/2013 | Zens | |
| 2016/0296023 | A1 | 10/2016 | Choi | |
| 2020/0305606 | A1 * | 10/2020 | Chen | A47C 4/286 |
| 2022/0248855 | A1 * | 8/2022 | Chen | A47C 4/286 |

* cited by examiner

FOLDABLE ROCKING CHAIR FRAME AND CHAIR HAVING SAME

CROSS-REFERENCE TO RELATED APPLICATIONS

The present application claims priority to Chinese Application Numbers CN 202121736178.4 filed Jul. 27, 2021, and CN 202122084670.4 filed Aug. 31, 2021, the disclosure of each application is incorporated herein for all purposes by reference in its entirety.

FIELD OF THE INVENTION

The present invention generally relates to foldable rocking chair frames and foldable rocking chairs.

BACKGROUND

Most existing rocking chair are not foldable. They take up a lot of space and are thus inconvenient for storage and transportation. Some existing rocking chairs are foldable, but folding and unfolding these chairs takes time and effort. Accordingly, these chairs are not easy to use.

Given the current state of the art, there remains a need for foldable rocking chair frames and foldable rocking chairs that address the abovementioned issues.

The information disclosed in this Background section is provided for an understanding of the general background of the invention and is not an acknowledgement or suggestion that this information forms part of the prior art already known to a person skilled in the art.

SUMMARY OF THE INVENTION

The present disclosure provides rocking chair frames and rocking chairs that are foldable and portable for easy use, storage and transportation.

In various exemplary embodiments, the present disclosure provides a foldable rocking chair frame. The frame includes a left side stand, a right side stand, and a connecting assembly. Each of the left and right side stands includes a rocking structure and a plurality of supports. The rocking structure and the plurality of supports are interconnected and foldable into each other. The rocking structure includes an arched member, a slider, and one or more links. When the frame is unfolded, the arched member has a first end portion disposed at a rear side of the frame and extends from the rear side of the frame toward a front side of the frame. The slider is disposed at the arched member and slidable along the arched member. Each of the one or more links has a first end portion pivotally connected to the arched member and a second end portion pivotally connected to a support in the plurality of supports. The plurality of supports includes a rear support. The rear support has a lower end portion pivotally connected to the slider, and serves as a rear leg of the frame when the frame is unfolded. The connecting assembly is disposed between the left side stand and the right side stand to connect the left and right side stands and allow the left and right side stands to fold into each other.

In some exemplary embodiments, for each of the left and right side stands, the rocking structure further includes a fixing member disposed at the first end portion of the arched member to prevent the first end portion of the arched member from disengaging from the slider, to abut against a ground when the frame is unfolded, or both.

In some exemplary embodiments, for each of the left and right side stands, the rocking structure further includes a post fixed or integrally formed at the second end portion of the arched member. The post is positioned at an angle with respect to the second end portion of the arched member. In addition, the first end portion of each of the one or more links is connected to the arched member through the post.

In an exemplary embodiment, the angle with respect to the second end portion of the arched member is about 90 degrees.

In some exemplary embodiments, for each of the left and right side stands, the plurality of supports further includes a front support, and the one or more links includes a first link and a second link. When the frame is unfolded, the front support serves as a front leg of the frame. The front support is inclined backward, and abuts against an upper end portion of the rear support. In addition, the second end portion of the first link is pivotally connected to the rear support and the second end portion of the second link is pivotally connected to the front support.

In some exemplary embodiments, for each of the left and right side stands, the plurality of supports further includes a linking support. The linking support has a first end portion pivotally connected to the upper end portion of the rear support and a second end portion pivotally connected to the front support.

In some exemplary embodiments, for each of the left and right side stands, the plurality of supports further includes a seating support. The seating support has a rear end portion pivotally connected to the rear support and a middle portion pivotally connected to the front support.

In some exemplary embodiments, for each of the left and right side stands, the plurality of supports further includes a backrest support. The backrest support has a lower end portion pivotally connected to the rear support. In addition, an upper end portion of the front support is pivotally connected to a first connector that is disposed at the backrest support and movable along the backrest support.

In some exemplary embodiments, for each of the left and right side stands, the plurality of supports further includes a seating support and a backrest support. The seating support has a rear end portion pivotally connected to the rear support and a middle portion pivotally connected to the front support. The backrest support has a lower end portion pivotally connected to the rear support. In addition, an upper end portion of the front support is pivotally connected to a first connector that is disposed at the backrest support and movable along the backrest support.

In some exemplary embodiments, for each of the left and right side stands, the plurality of supports further includes an upright support and an armrest support. The upright support has a lower end portion pivotally connected to a second connector that is disposed at the front support and a middle portion pivotally connected to the seating support. The armrest support has a rear end portion pivotally connected to the backrest below the first connector and a front end portion pivotally connected to an upper end portion of the upright support.

In some exemplary embodiments, the connecting assembly includes a pair of front cross members and a pair of rear cross members. The front cross members are pivotally connected to each other at their middle portions. One front cross member has a lower end portion pivotally connected to the front support of the left side stand and an upper end portion pivotally connected to the seating support of the right side stand. The other front cross member has a lower end portion pivotally connected to the front support of the right side stand and an upper end portion pivotally connected to the seating support of the left side stand. The rear cross members are pivotally connected to each other at their middle portions. One rear cross member has a lower end portion pivotally connected to the rear support of the left side stand and an upper end portion pivotally connected to the first connector at the backrest support of the right side stand. The other rear cross member has a lower end portion pivotally connected to the rear support of the right side stand and an upper end portion pivotally connected to the first connector at the backrest support of the left side stand.

In an exemplary embodiment, the frame further includes a first strengthening member and a second strengthening member. The first strengthening member has a first end portion pivotally connected to the pair of front cross members and a second end portion pivotally connected to the first link of the rocking structure of the left side stand. The second strengthening member has a first end portion pivotally connected to the pair of front cross members, and a second end portion pivotally connected to the first link of the rocking structure of the right side stand.

In some exemplary embodiments, for each of the left and right side stands, an upper portion of the rear support serves as a backrest support when the frame is unfolded.

In some exemplary embodiments, for each of the left and right side stands, the plurality of supports further includes a front support, a first cross support and a second cross support. The front support has a length that is adjustable. The first and second cross supports are pivotally connected to each other at their middle portions. The first cross support has a lower end portion pivotally connected to the lower end portion of the rear support, and an upper end portion pivotally connected to an upper portion of the front support. The second cross support has a lower end portion pivotally connected to a lower end portion of the front support, and an upper end portion pivotally connected to a first connector disposed at the rear support and movable along the rear support.

In an exemplary embodiment, the one or more links include a first link and a second link. The first link has the second end portion pivotally connected to the first cross support, and the second link has the second end portion pivotally connected to the second cross support.

In another exemplary embodiment, the one or more links include a first link. The first link has the second end portion pivotally connected to a second connector disposed at the rear support below the first connector and movable along the rear support, and a middle portion pivotally connected to the first cross support.

In a further exemplary embodiment, the one or more links include a first link and a second link. The first link has the second end portion pivotally connected to a second connector disposed at the rear support below the first connector and movable along the rear support, and a middle portion pivotally connected to the first cross support. The second link has the second end portion pivotally connected to the second cross support.

In some exemplary embodiments, the connecting assembly includes a pair of front cross members and a pair of rear cross members. The front cross members are pivotally connected to each other at their middle portions. Each of the front cross members has a lower end portion pivotally connected to a lower end portion of the front support of one of the left and right side stands, and an upper portion slidably coupled with a third connector disposed at an upper end portion of the front support of the other of the left and right side stands. The rear cross members are pivotally connected to each other at their middle portions. Each of the rear cross members has a lower end portion pivotally connected to a lower end portion of the rear support of one of the left and right side stands, and an upper end portion pivotally connected to the first connector disposed at the rear support of the other of the left and right side stands.

In an exemplary embodiment, the upper portion of each of the front cross members extends upward and outward beyond the third connector when the frame is unfolded.

In various exemplary embodiments, the present disclosure provides a chair. The chair includes a frame disclosed herein and a chair cloth coupled with the frame.

The frames and chairs of the present disclosure have other features and advantages that will be apparent from, or are set forth in more detail in, the accompanying drawings, which are incorporated herein, and the following Detailed Description, which together serve to explain certain principles of exemplary embodiments of the present disclosure.

BRIEF DESCRIPTION OF THE DRAWINGS

The accompanying drawings, which are incorporated into and constitute a part of this specification, illustrate one or more exemplary embodiments of the present disclosure and, together with the Detailed Description, serve to explain the principles and implementations of exemplary embodiments of the invention.

Figure 1:
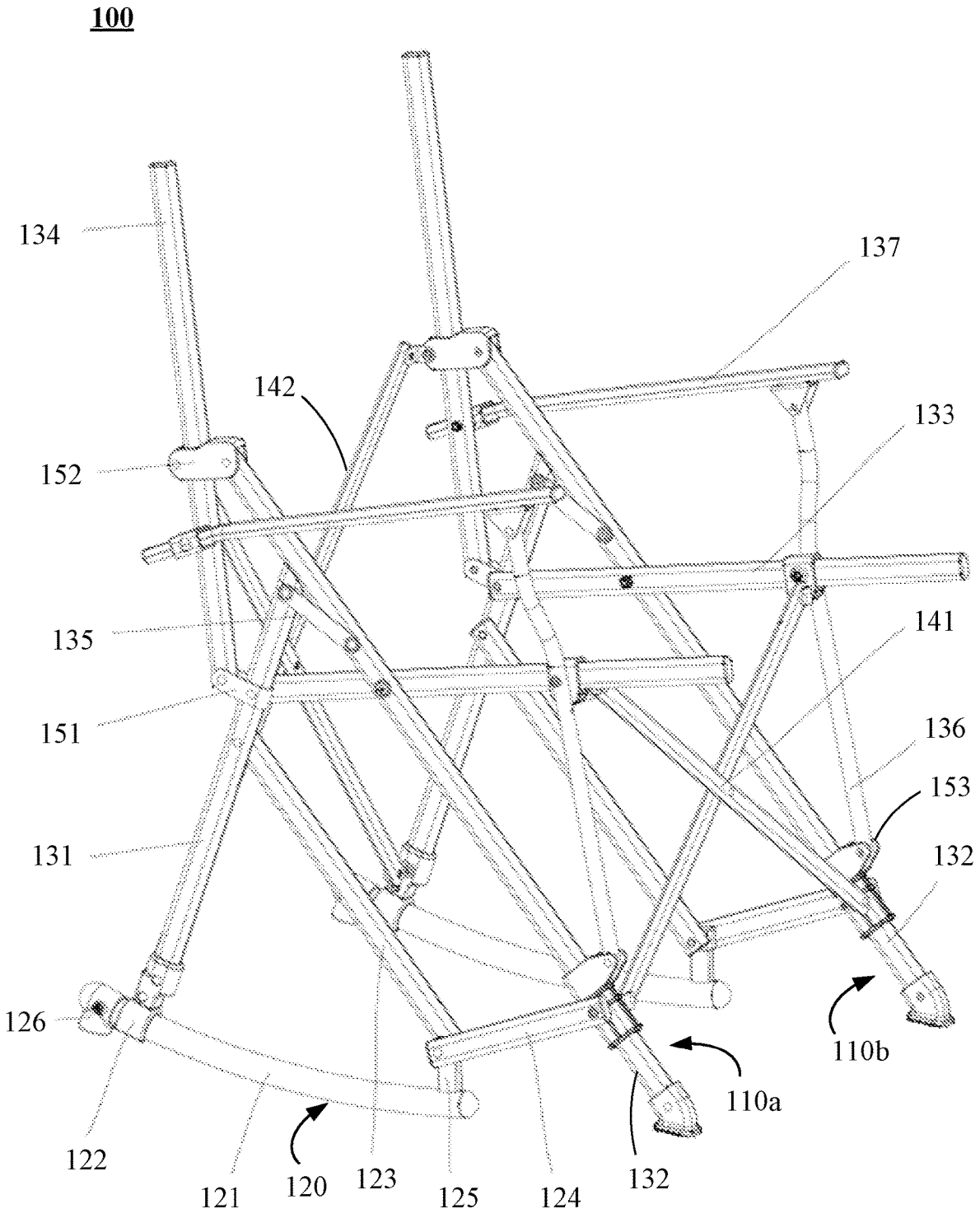
FIG. 1 is a perspective view illustrating an exemplary frame in an unfolded state in accordance with some exemplary embodiments of the present disclosure.
Figure 2:
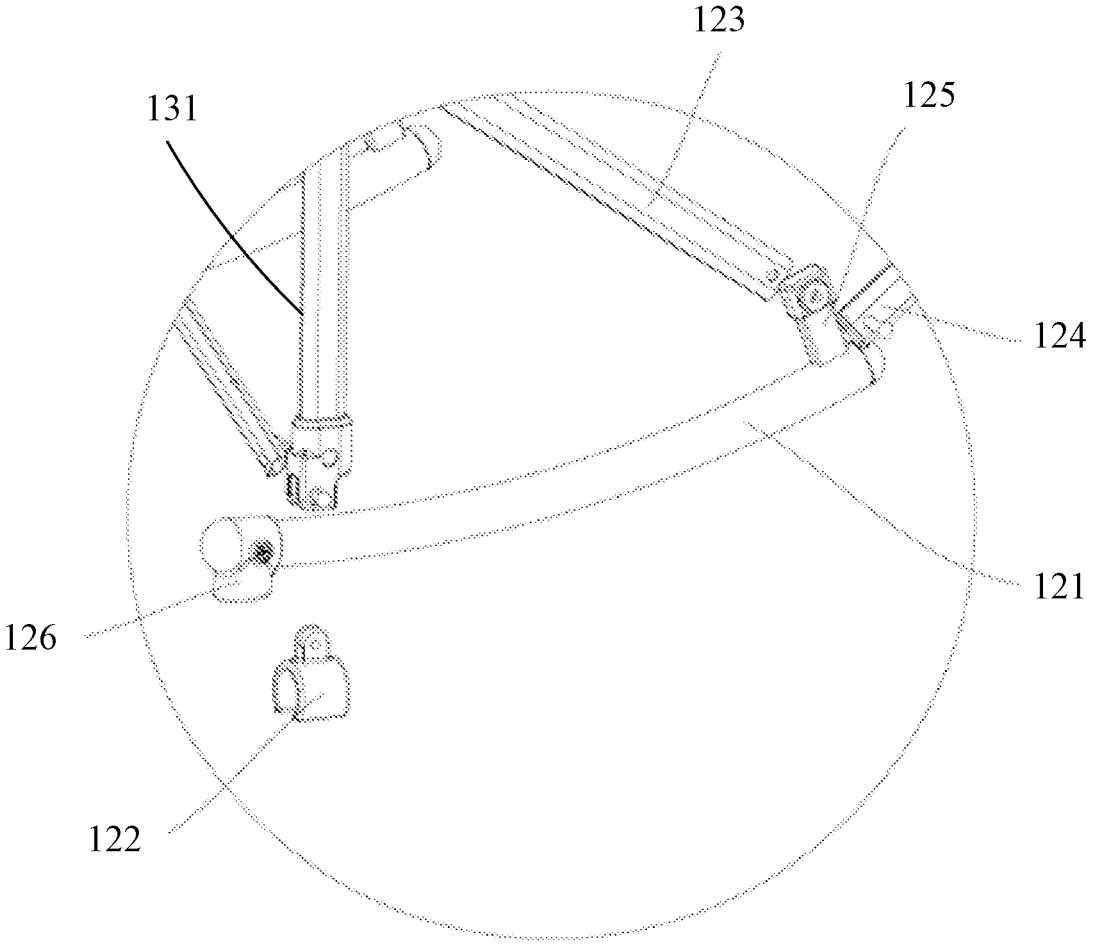
FIG. 2 is a partially dissembled view illustrating an exemplary rocking structure in accordance with some exemplary embodiments of the present disclosure.
Figure 3:
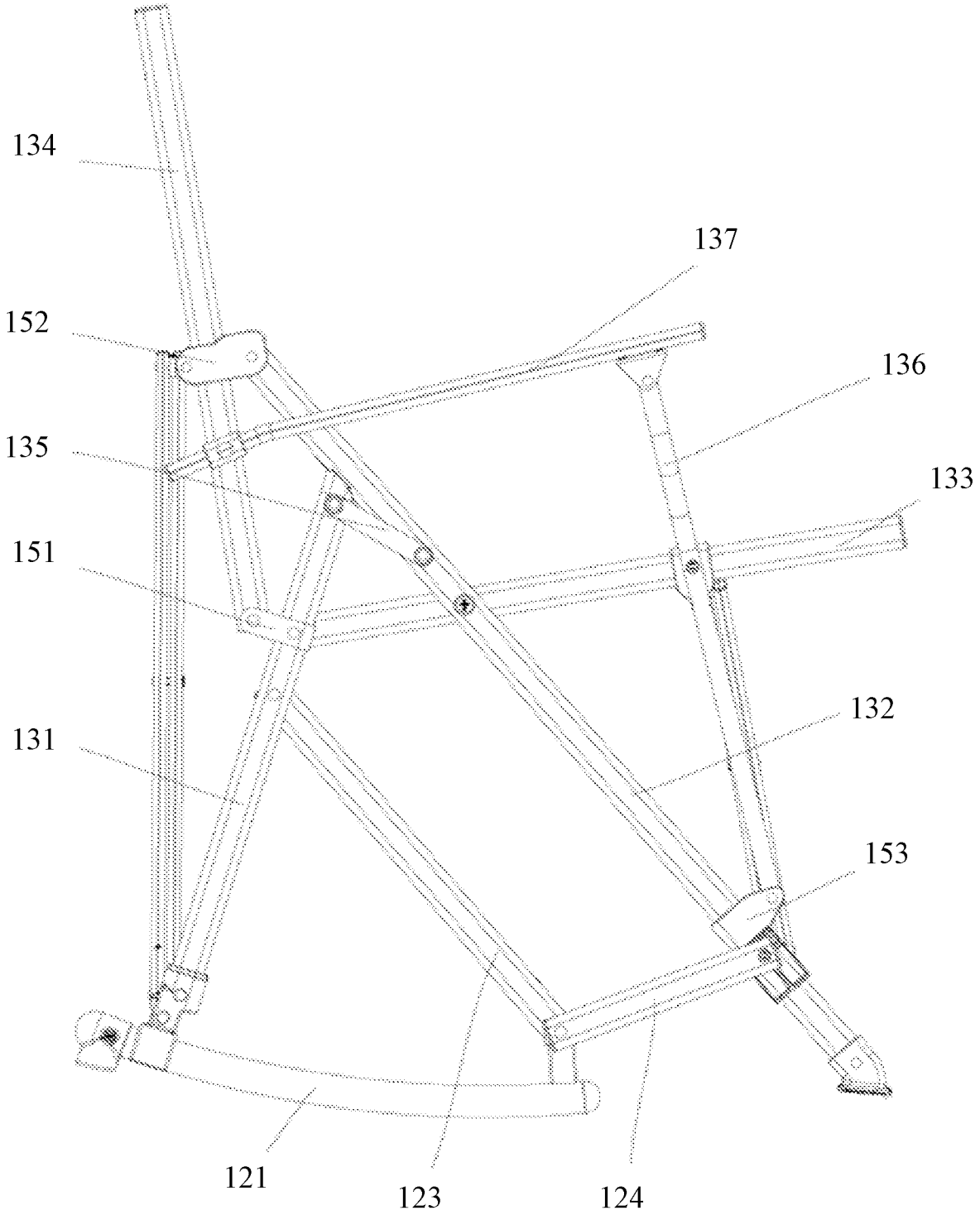
FIG. 3 is a side view illustrating the exemplary frame of FIG. 1.

As will be apparent to those of skill in the art, the components illustrated in the figures described above are combinable in any useful number and combination. The figures are intended to be illustrative in nature and are not limiting.

DETAILED DESCRIPTION

Reference will now be made in detail to implementations of exemplary embodiments of the present disclosure as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present disclosure will readily suggest themselves to such skilled persons having benefit of this disclosure.

In the interest of clarity, not all of the routine features of the implementations described herein are shown and described. It will be appreciated that, in the development of any such actual implementation, numerous implementation-specific decisions are made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the exemplary embodiments set forth in this disclosure can be made without departing from the spirit and scope of the exemplary embodiments, as will be apparent to those skilled in the art. The specific exemplary embodiments described herein are offered by way of example only, and the disclosure is to be limited only by the terms of the appended claims, along with the full scope of equivalents to which such claims are entitled.

Embodiments of the present disclosure are described in the context of foldable rocking chair frames and foldable rocking chairs. A foldable rocking chair generally includes a foldable rocking chair frame and a chair cloth coupled with and supported by the foldable rocking chair frame. A foldable rocking chair frame generally includes a first stand and a second stand, which are disposed on the left side and the right side of the frame when the frame is unfolded. Each of the first and second stands includes a rocking structure and a plurality of supports that are interconnected and foldable into each other. A foldable rocking chair frame also includes a connecting assembly that connects the first and second stands and allows the first and second stands to fold into each other.

Referring now to FIGS. 1-6, there is depicted an exemplary foldable rocking chair frame 100 in accordance with some exemplary embodiments of the present disclosure. Frame 100 includes a first stand and a second stand, such as stand 110*a* and stand 110*b*. Stand 110*a* and stand 110*b* can be but do not have to be identical or symmetrical to each other. As a non-limiting example, stand 110*a* and stand 110*b* are shown to be identical or symmetrical to each other. When the frame is unfolded, the first stand is disposed at the left side of the frame and is thus also termed the left side stand. Similarly, when the frame is unfolded, the second stand is disposed at the right side of the frame and is thus also termed the right side stand.

In some exemplary embodiments, a stand (e.g., the first stand, the second stand or each of the first and second stands) includes a rocking structure, such as rocking structure 120. Rocking structure 120 includes an arched member, such as arched member 121. The arched member is generally elongated and has a first end portion and a second end portion. When the frame is unfold, the first end portion of the arched member is disposed at the rear side of the frame, and the arched member extends from the rear side of the frame toward the front side of the frame. At least a portion of the arched member is arched, e.g., curved or the like. For instance, in an exemplary embodiment, at least about 10%, about 20%, about 30%, about 40% or more of the arched member is arched or the like. In another embodiments, at least about 50%, about 60%, about 70%, about 80% or more of the arched member is arched or the like. In an exemplary embodiment, at least about 90% or substantially the entirety of the arched member is arched or the like.

Rocking structure 120 also includes a slider, such as slider 122. Slider 122 is disposed at the arched member and slidable along the arched member. Slider 122 can have a variety of configurations. For instance, in an exemplary embodiment, slider 122 is a sheath-like member or a tubular member that sleeves on the arched member. In another exemplary embodiment, slider 122 includes a circular member or a portion of a circular member that is configured to be slidably coupled with the arched member. When the frame is in use, slider 122 can sway back and forth on the arched member.

Rocking structure 120 further includes one or more links, each having an end portion pivotally connected to the arched member. For instance, in the illustrated embodiment, the one or more links include a first link, such as first link 123, and a second link, such as second link 124. Each of the first and second links has an end portion (e.g., the lower end portions of the first and second links in FIG. 1) pivotally connected to the arched member. For instance, in the illustrated embodiment, the first and second links is pivotally connected to the arched member through post 125. Post 125 can be an individual part that is fixed on the arched member or an integral part that is formed with the arched member. Preferably, post 125 is fixed or formed at a location toward the second end portion of the arched member. In some exemplary embodiments, post 125 is oriented at an angle with respect to the second end portion of the arched member. For instance, in an exemplary embodiments, post 125 is at an angle of about 60 degrees, about 70 degrees, about 80 degrees, about 90 degrees, about 100 degrees, about 110 degrees, or about 120 degrees with respect to the second end portion of the arched member. When the frame is unfolded, the first link, second link and post collectively form a substantially "Y" shaped structure that can enhance the stability of the frame and distribute the load among different components while the frame or chair having the frame is in use.

In some exemplary embodiments, rocking structure 120 includes a fixing member, such as fixing member 126. The fixing member is disposed at (e.g., coupled with or integrally formed with) the first end portion of the arched member. The fixing member is configured to prevent the first end portion of the arched member from disengaging from the slider, e.g., preventing the first end portion of the arched member from pulling out of the slider. In an exemplary embodiment, the fixing member is configured to abut against a ground when the frame is unfolded. In another exemplary embodiment, the fixing member is configured to prevent the first end portion of the arched member from disengaging from the slider and abut against a ground when the frame is unfolded.

In some exemplary embodiments, a stand also includes a plurality of supports. The plurality of supports and the rocking structure are interconnected to each other and foldable relative to each other. For instance, in some exemplary embodiments, a stand includes a rear support, such as rear support 131, and a front support, such as front support 132. The rear support serves as a rear leg of the frame and the front support serves as a front leg of the frame. The rear support can be vertical or oblique; and can be but do not have to be on the rear side of the frame, at least not entirely. Similarly, the front support can be vertical or oblique; and can be but do not have to be on the front side of the frame, at least not entirely. For instance, in the illustrated embodiment, the rear support has a lower end portion pivotally connected to the slider, and is inclined forward when the frame is unfolded. The front support is inclined backward and abuts against an upper end portion of the rear support. In such an embodiment, first link 123 of the rocking structure is pivotally connected to the rear support and second link 124 of the rocking structure is pivotally connected to the front support.

In some exemplary embodiments, a stand includes a seating support, such as seating support 133. The seating support has a rear end portion pivotally connected to the rear support and a middle portion pivotally connected to the front support. The seating support is configured to couple and support a chair cloth, e.g., a portion of the chair cloth serving as a seat. In some exemplary embodiments, when the frame is unfolded, the seating support is substantially horizontal or slightly inclined backward.

In some exemplary embodiments, a stand includes a backrest support, such as backrest support 134. The backrest support has a lower end portion pivotally connected to the rear support, for instance, through connector 151 disposed at the rear support. The backrest support is configured to couple and support a chair cloth, e.g., a portion of the chair cloth that serves as a backrest. In an exemplary embodiment, the upper end portion of the front support is pivotally connected to connector 152 that is disposed at the backrest support and movable along the backrest support.

In some exemplary embodiments, a stand includes a linking support, such as linking support 135. The linking support has an end portion pivotally connected to the rear support and another end portion pivotally connected to the front support. In an exemplary embodiment, the linking support is disposed above the seating support when the frame is unfolded. In such an embodiment, the linking support has an end portion pivotally connected to the upper end portion of the rear support (e.g., at a position adjacent to where the front support abutting the rear support) and another end portion pivotally connected to the front support.

In some exemplary embodiments, a stand includes an upright support, such as upright support 136. The lower end portion of the upright support is pivotally connected to connector 153, which is disposed at the front support and movable (e.g., slidable) along the front support. The middle portion of the upright support is pivotally connected to the seating support.

In some exemplary embodiments, a stand includes an armrest support, such as armrest support 137. The rear end portion of the armrest support is connected to the backrest below connector 152. The front end portion of the armrest support is pivotally connected to the upper end portion of the upright support. In some exemplary embodiments, when the frame is unfolded, the armrest support is substantially parallel to the seating support.

Frame 100 also includes a connecting assembly disposed between the left side stand and the right side stand to connect the left and right side stands and to allow the left and right side stands to fold into each other. For instance, in the illustrated embodiments, the connecting assembly includes a pair of front cross members, such as the pair of front cross members 141, and a pair of rear cross members, such as the pair of rear cross members 142.

The middle portions of the front cross members are pivotally connected to each other. In some exemplary embodiments, one front cross member has a lower end portion pivotally connected to the front support of the left side stand and an upper end portion pivotally connected to the seating support of the right side stand. The other front cross member has a lower end portion pivotally connected to the front support of the right side stand and an upper end portion pivotally connected to the seating support of the left side stand. Preferably, the upper end portion of a front cross member is pivotally connected to the seating support of the left or right side stand at or adjacent to where the upright support is connected to the seating support. In an exemplary embodiment, the upper portion of a front cross member, the middle portion of the upright support, and the seating support are connected to each other through a connector, such as a connector disposed at the seating support.

Middle portions of the rear cross members are pivotally connected to each other. In some exemplary embodiments, one rear cross member has a lower end portion pivotally connected to the rear support of the left side stand and an upper end portion pivotally connected to connector 152 disposed at the backrest support of the right side stand. The other rear cross member has a lower end portion pivotally connected to the rear support of the right side stand and an upper end portion pivotally connected to connector 152 disposed at the backrest support of the left side stand.

Figure 4:
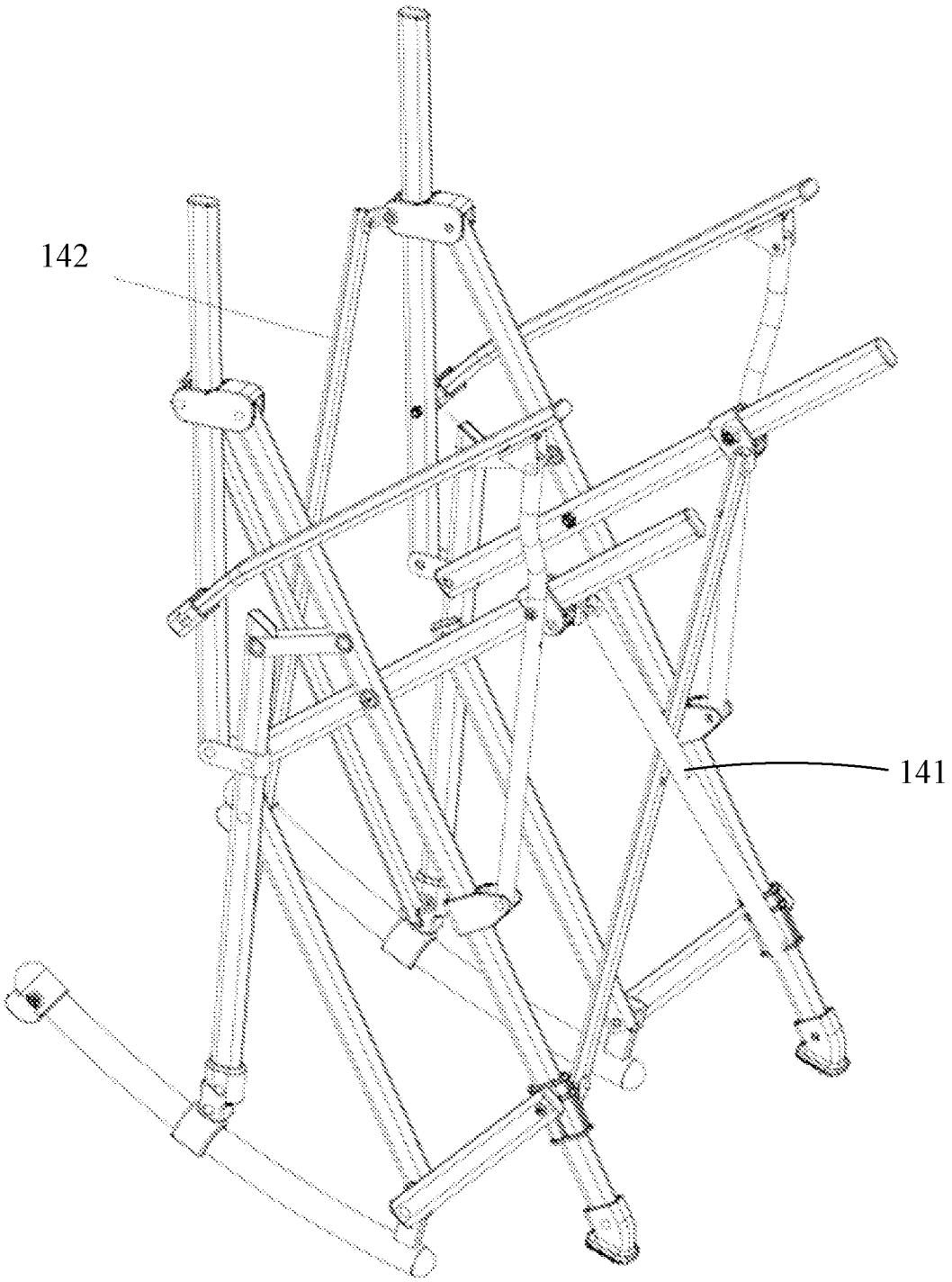
FIG. 4 is a perspective view illustrating the exemplary frame of FIG. 1 in an intermediate state.
Figure 5:
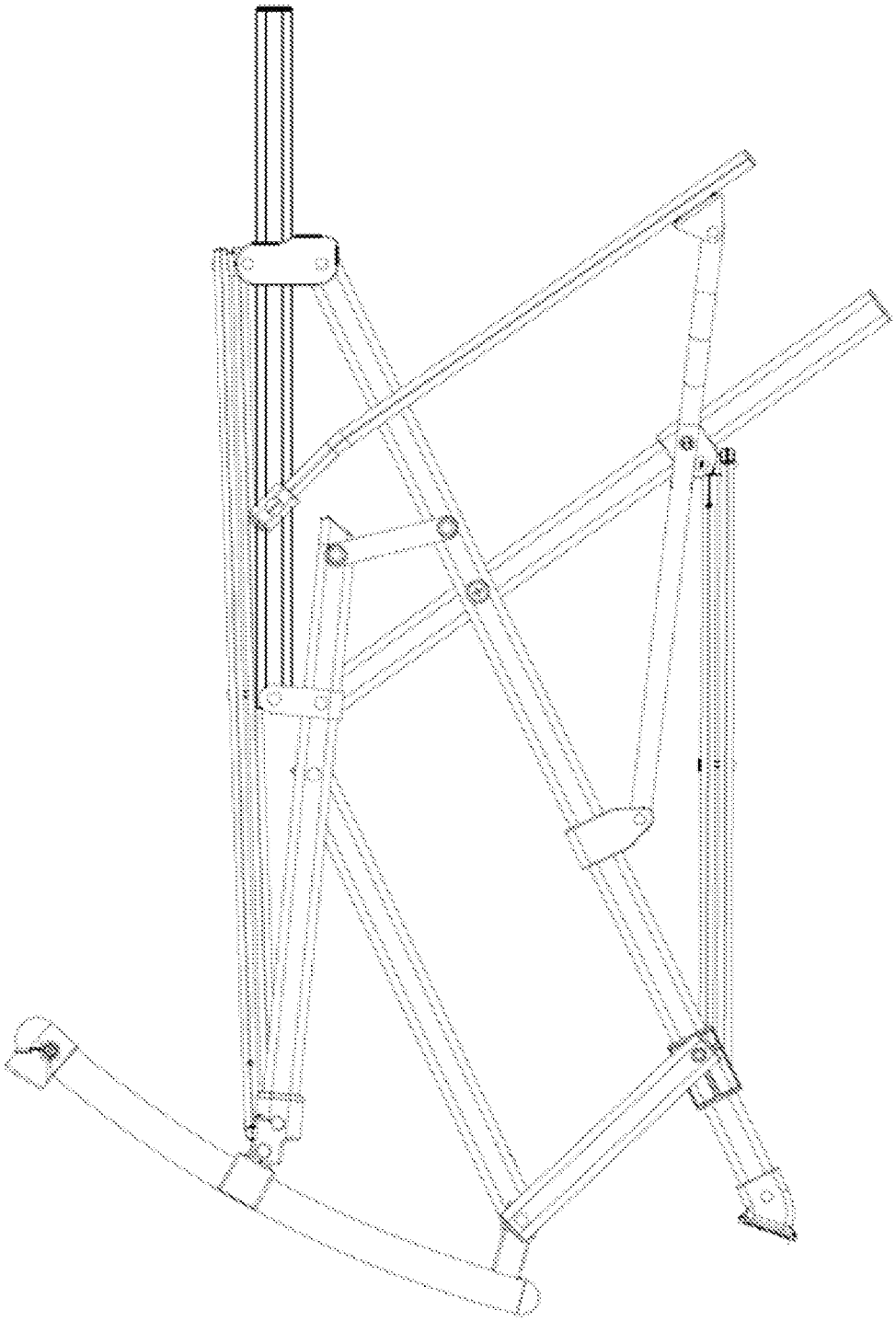
FIG. 5 is a side view illustrating the exemplary frame of FIG. 1 in an intermediate state.
Figure 6:
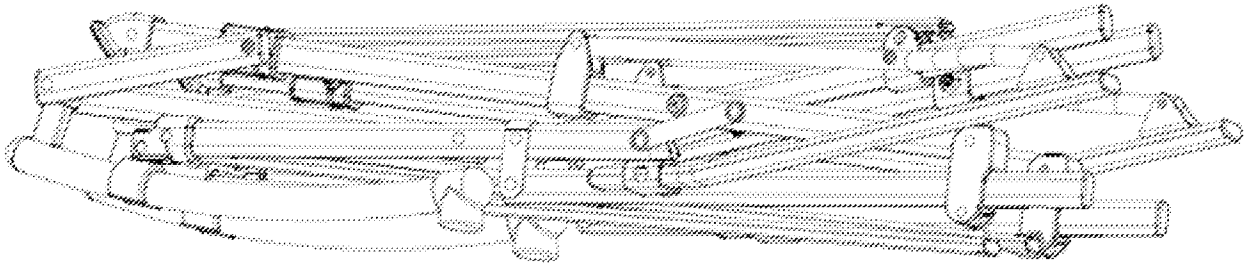
FIG. 6 is a perspective view illustrating the exemplary frame of FIG. 1 in a folded state.

Frame 100 is easy to fold and unfold. For instance, as a non-limiting example, one can push the front portions of the seat supports upward as illustrated in FIGS. 4 and 5, to fold frame 100. This will push the upper end portions of the rear supports away from the front supports, move sliders 122 along the arched members toward the front side of the frame, move connectors 152 upward along the backrest supports, move connectors 153 upward along the front supports and rotate other components (e.g., arched member, links, supports, front cross members and back cross members). As a result, all components, including the rocking structures of both the left and right stands, are retracted toward one another and folded in a compact manner as illustrated in FIG. 6. To unfold frame 100, one can pull the front portions of the seat supports downward. This will reverse the processes and unfold the frame. Should the frame be coupled with a chair cloth, the chair cloth can be folded and unfolded along with the frame.

While it is illustrated that frame 100 includes the front support, rear support, seating support, backrest support, linking support, upright support and armrest support, it should be noted that some of the supports are optional, additional or alternative. For instance, a frame can include only the front support, rear support, seating support, backrest support and linking support. A frame can include the front support, rear support, seating support, backrest support and/or a support alternative to the linking support.

Figure 7:
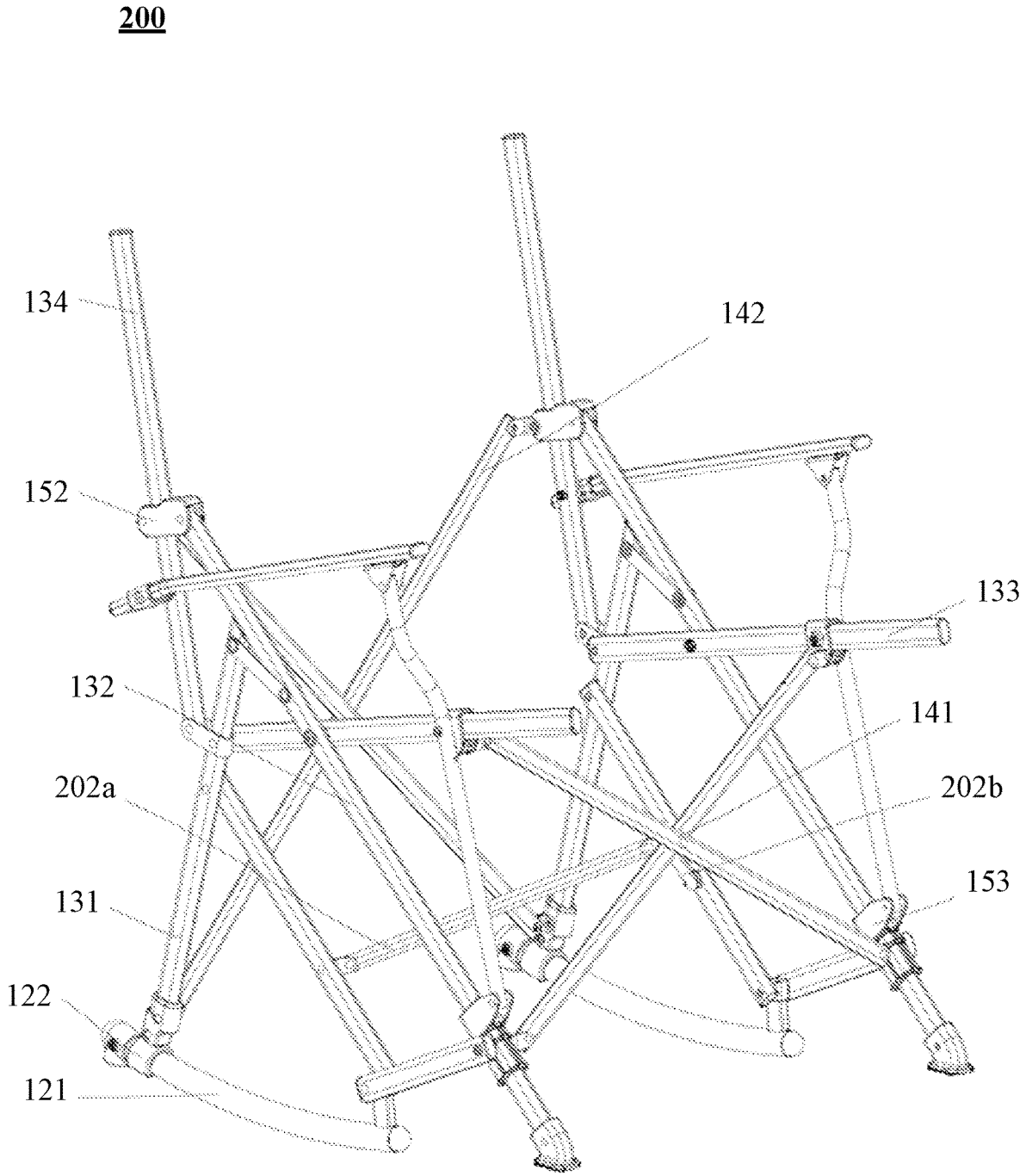
FIG. 7 is a perspective view illustrating an exemplary frame in an unfolded state in accordance with some exemplary embodiments of the present disclosure.
Figure 8:
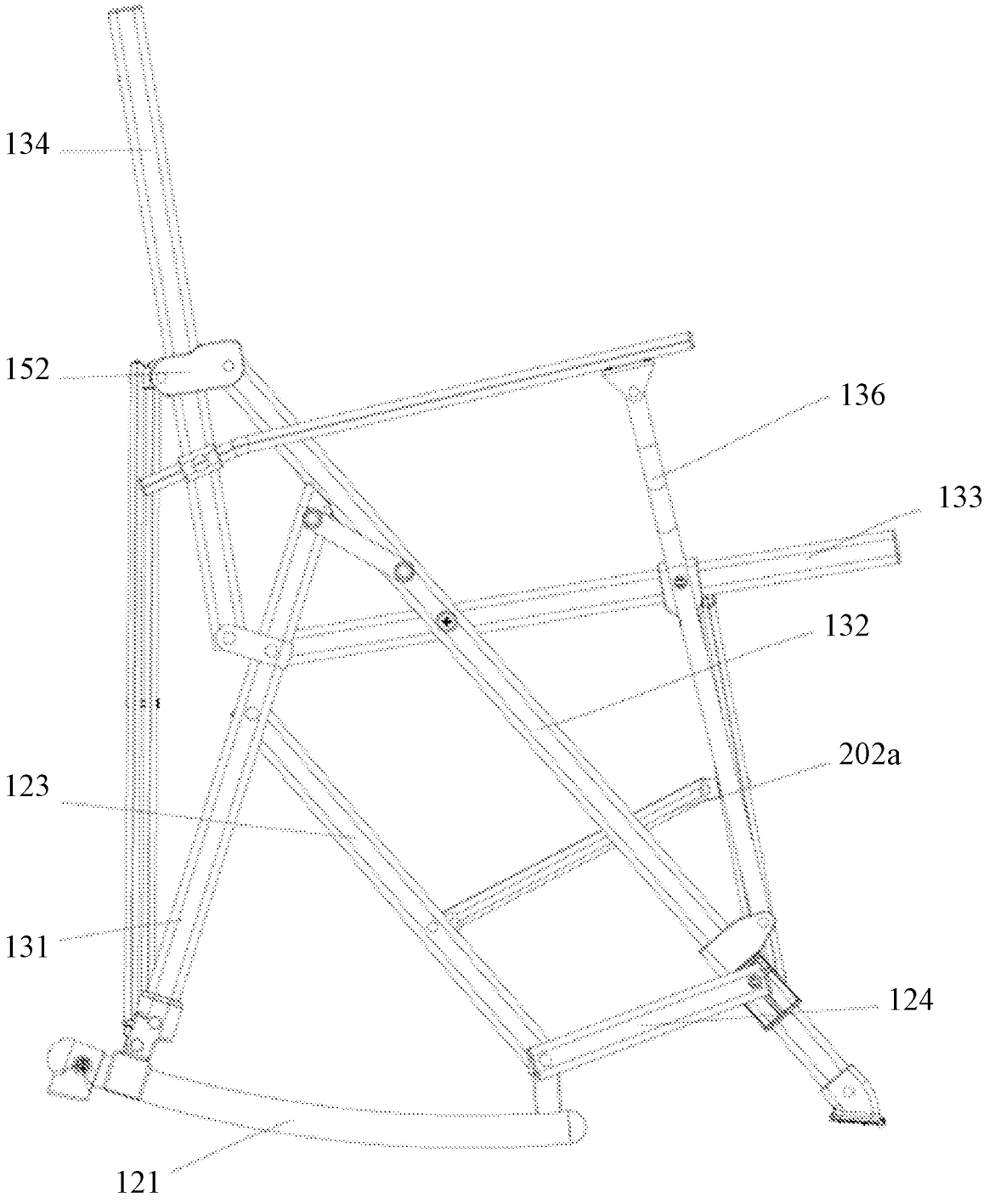
FIG. 8 is a side view illustrating the exemplary frame of FIG. 7.
Figure 9:
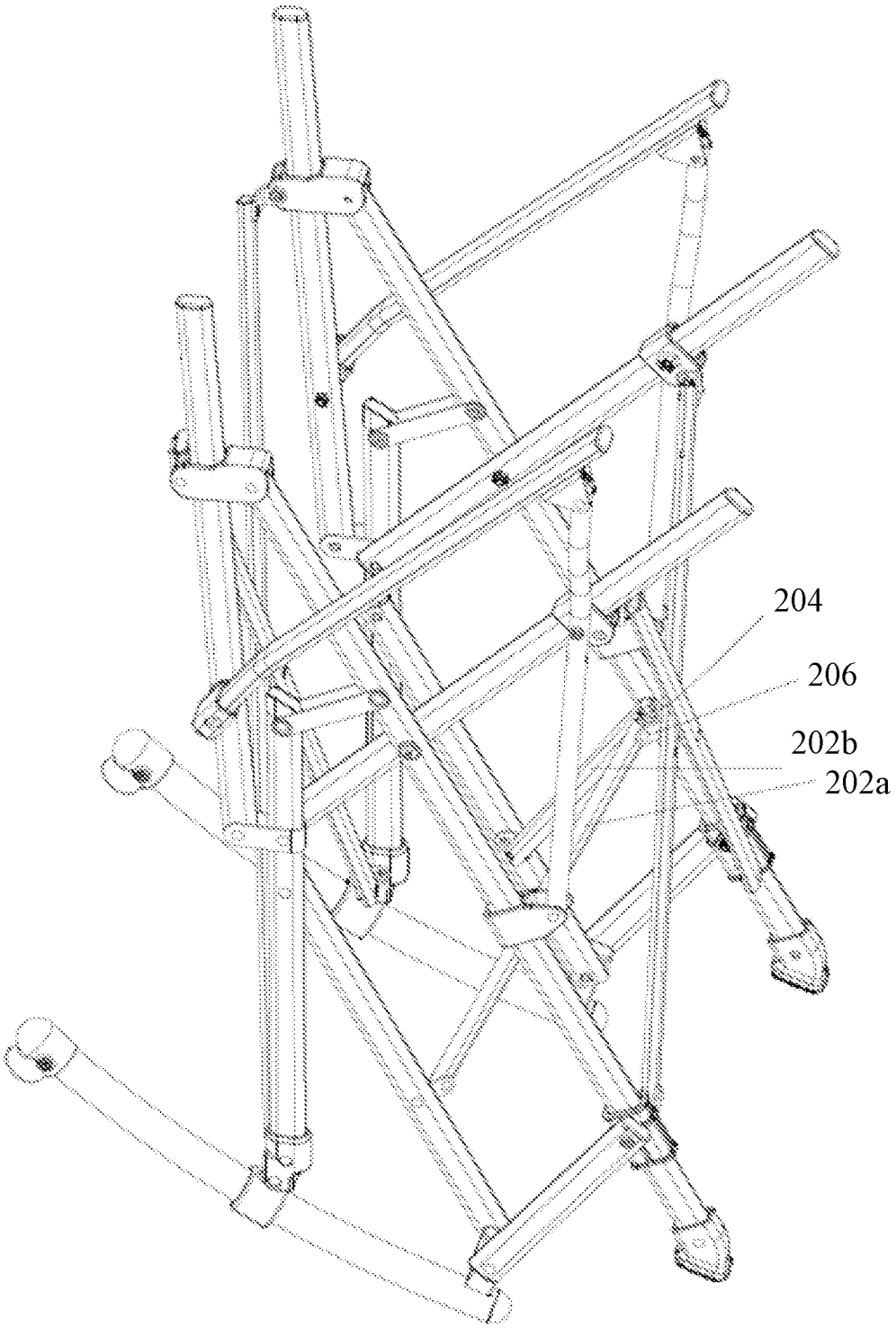
FIG. 9 is a perspective view illustrating the exemplary frame of FIG. 7 in an intermediate state.
Figure 10:
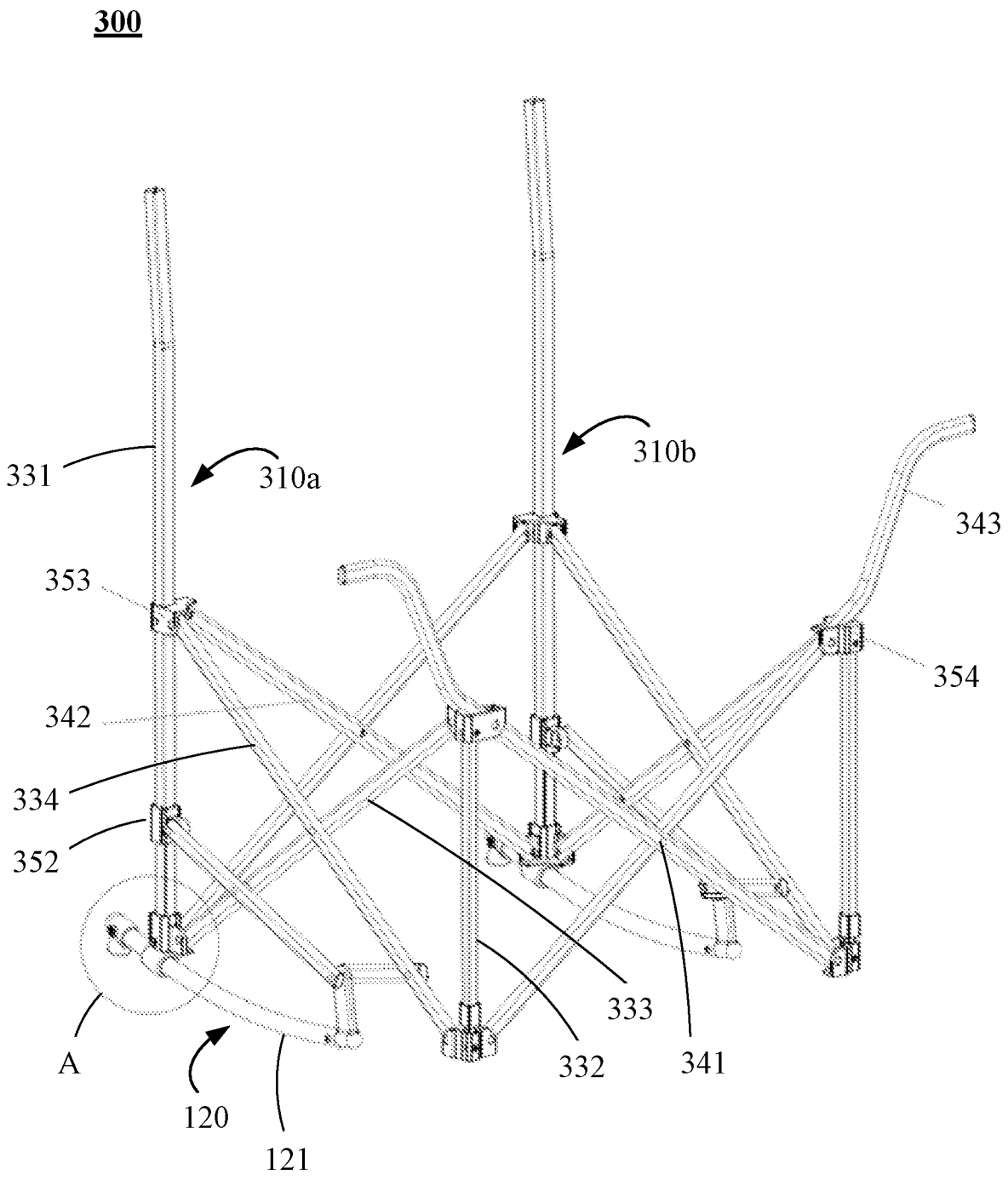
FIG. 10 is a perspective view illustrating an exemplary frame in an unfolded state in accordance with some exemplary embodiments of the present disclosure.
Figure 11:
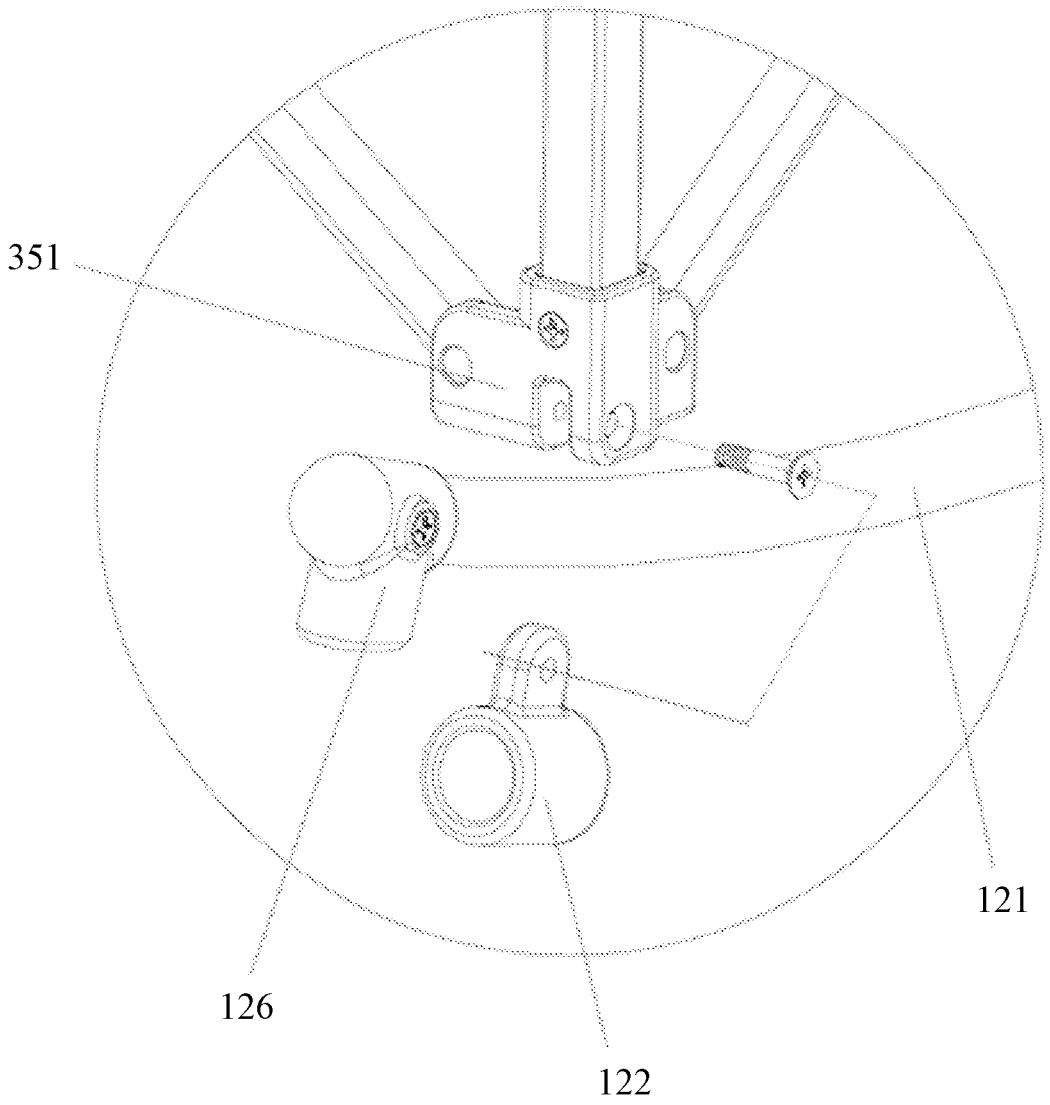
FIG. 11 is a partially disassembled view taken along circle A of FIG. 10.
Figure 12:
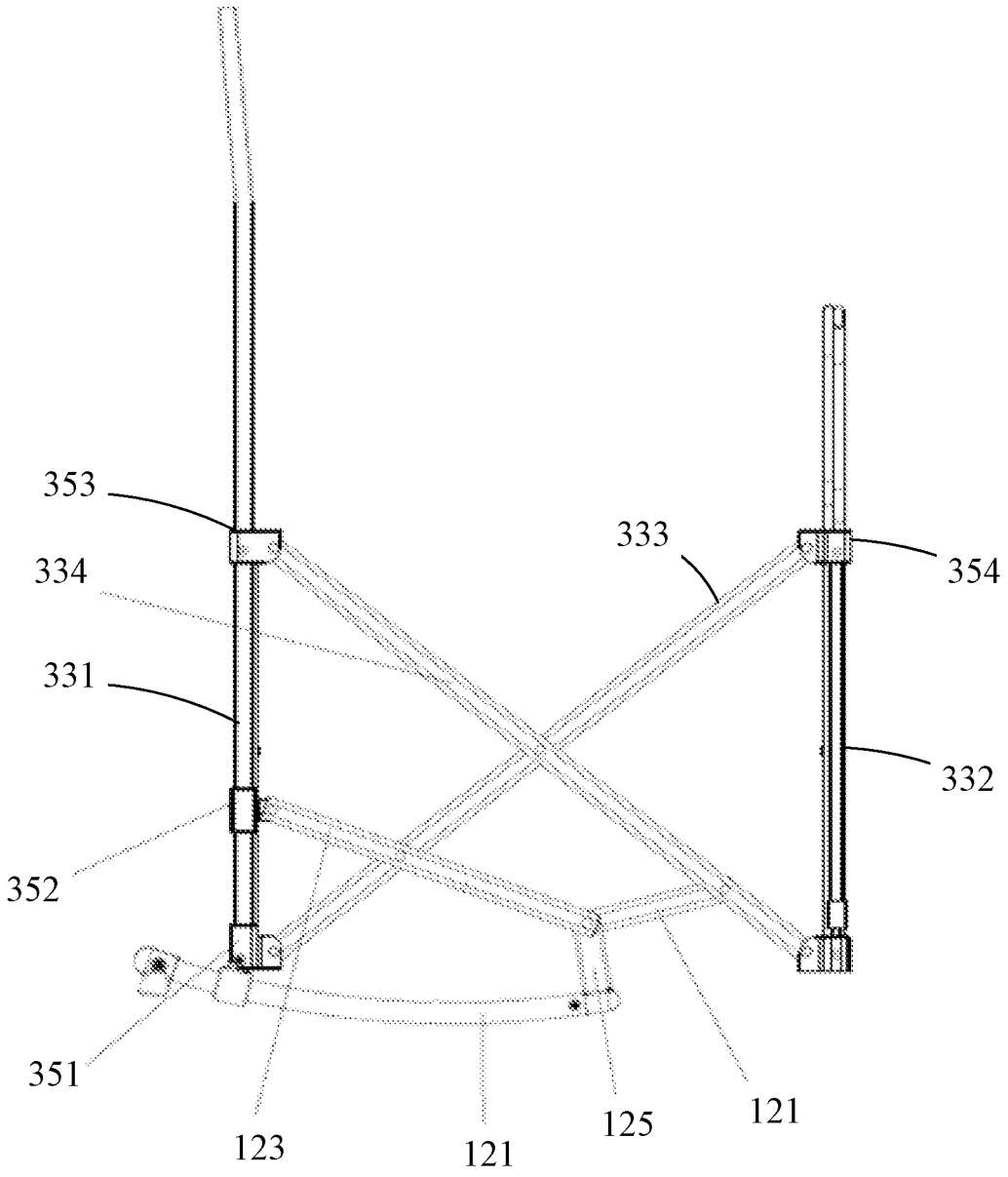
FIG. 12 is a side view illustrating the exemplary frame of FIG. 10.

A frame can further include other optional, additional or alternative components. For instance, as a non-limiting example, FIGS. 7-9 illustrate an exemplary frame 200 in accordance with some exemplary embodiments of the present disclosure. Frame 200 is substantially the same as frame 100, except frame 200 further includes a first strengthening member, such as first strengthening member 202*a*, and a second strengthening member, such as second strengthening member 202*b*. The first and second strengthening members enhance the stability of the frame and/or prevents the frame from moving or shaking sideways (e.g., from left to right or vice versa).

In some exemplary embodiments, one end portion of the first strengthening member is pivotally connected to the pair of front cross members, for instance, through connector 204 disposed at the pair of front cross members. Another end portion of the first strengthening member is pivotally connected to first link 123 of the rocking structure of the left side stand. Similarly, one end portion of the second strengthening member is pivotally connected to the pair of front cross members, for instance, through connector 204. Another end portion of the second strengthening member is pivotally connected to first link 123 of the rocking structure of the right side stand. In some exemplary embodiments, connector 204 includes one or more lugs, such as lug 206, for connecting the first and second strengthening members.

Referring now to FIGS. 10-14, there is depicted an exemplary foldable rocking chair frame 300 in accordance with some exemplary embodiments of the present disclosure. Frame 300 includes a first stand and a second stand, such as stand 310*a* and stand 310*b*. Like stand 110*a* and stand 110*b*, stand 310*a* and stand 310*b* can be but do not have to be identical or symmetrical to each other. As a non-limiting example, stand 310*a* and stand 310*b* are shown to be identical or symmetrical to each other. When the frame is unfolded, the first stand is disposed at the left side of the frame and is thus also termed the left side stand. Similarly, when the frame is unfolded, the second stand is disposed at the right side of the frame and is thus also termed the right side stand.

Like frame 100, in some exemplary embodiments, a stand (e.g., the first or second or each stand) of frame 300 includes a rocking structure, such as rocking structure 120 disclosed herein, and a plurality of supports. Like those in frame 100, the rocking structure and the plurality of supports of each stand of frame 300 are interconnected to each other and foldable relative to each other. For instance, in some exemplary embodiments, a stand of frame 300 includes a rear support, such as rear support 331, and a front support, such as front support 332. The rear support has a lower end portion pivotally connected to the slider of the rocking structure. When the frame is unfolded, the rear support is substantially vertical and serves as a rear leg of the frame. In some exemplary embodiments, the upper portion of the rear support serves as a backrest support when the frame is unfolded, e.g., configured to couple and support a chair cloth or a portion of the chair cloth that serves as a backrest. The front support has a length that is adjustable. For instance, in an exemplary embodiment, the front support includes two supporting segments that are telescopically coupled with each other. When the frame is unfolded, the front support is substantially vertical and serves as a front leg of the frame.

In some exemplary embodiments, a stand of frame 300 also includes a first cross support, such as first cross support 333, and a second cross support, such as second cross support 334. Middle portions of the first and second cross supports are pivotally connected to each other. In some exemplary embodiments, the lower end portion of the first cross support is pivotally connected to the lower end portion of the rear support, for instance, through connector 351 disposed at the lower end portion of the rear support. The upper end portion of the first cross support is pivotally connected to the upper portion of the front support, for instance, through connector 354 disposed at the upper portion of the front support. The lower end portion of the second cross support is pivotally connected to the lower end portion of the front support. The upper end portion of the second cross support is pivotally connected to connector 353, which is disposed at the rear support and movable along the rear support.

In some exemplary embodiments, the first link has one end portion pivotally connected to the arched member (e.g., through post 125) and another end portion pivotally connected to connector 352, which is disposed at the rear support below connector 353 and movable along the rear support. The middle portion of the first link is pivotally connected to the first cross support. The second link has one end portion pivotally connected to the arched member (e.g., through post 125) and another end portion pivotally connected to the second cross support.

Like frame 100, frame 300 also includes a connecting assembly disposed between the left side stand and the right side stand to connect the left and right side stands of frame 300 and to allow the left and right side stands of frame 300 to fold into each other. For instance, in the illustrated embodiments, the connecting assembly includes a pair of front cross members, such as the pair of front cross members 341, and a pair of rear cross members, such as the pair of rear cross members 342.

The middle portions of front cross members 341 are pivotally connected to each other. In some exemplary embodiments, one front cross member 341 has a lower end portion pivotally connected to the lower end portion of front support 332 of the left side stand, and an upper portion slidably coupled with connector 354 disposed at an upper end portion of front support 332 of the right side stand. Likewise, another front cross member 341 has a lower end portion pivotally connected to the lower end portion of front support 332 of the right side stand, and an upper portion slidably coupled with connector 354 disposed at an upper end portion of front support 332 of the left side stand.

The middle portions of rear cross members 342 are pivotally connected to each other. In some exemplary embodiments, one rear cross member 342 has a lower end portion pivotally connected to a lower end portion of rear support 331 of the left side stand (e.g., through connector 351), and an upper end portion pivotally connected to connector 353 disposed at rear support 331 of the right side stand. Likewise, another rear cross member 342 has a lower end portion pivotally connected to a lower end portion of rear support 331 of the right side stand (e.g., through connector 351), and an upper end portion pivotally connected to connector 353 disposed at rear support 331 of the left side stand.

In some exemplary embodiments, when the frame is unfolded, upper portion 343 of each of the front cross members extends upward and outward beyond connector 354. The upper portions of the front cross members, along with the upper portions of the rear supports, are configured to couple and support a chair cloth, e.g., a portion of the chair cloth serving as armrests.

Figure 13:
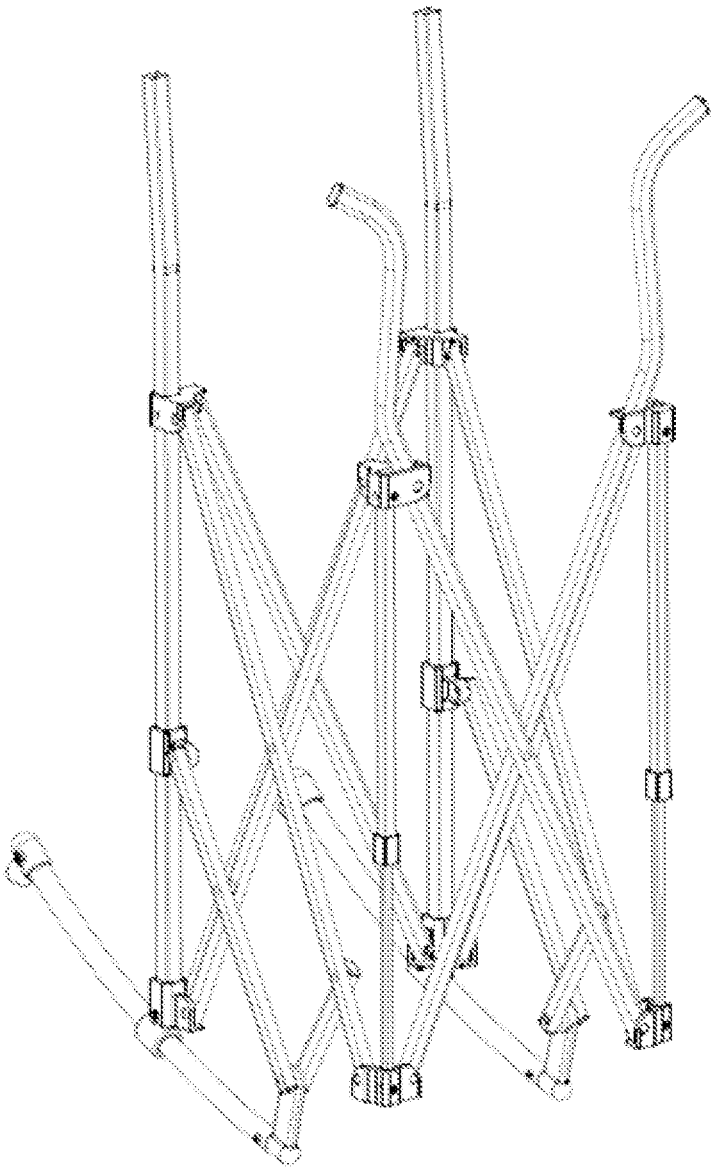
FIG. 13 is a side view illustrating the exemplary frame of FIG. 10 in an intermediate state.
Figure 14:
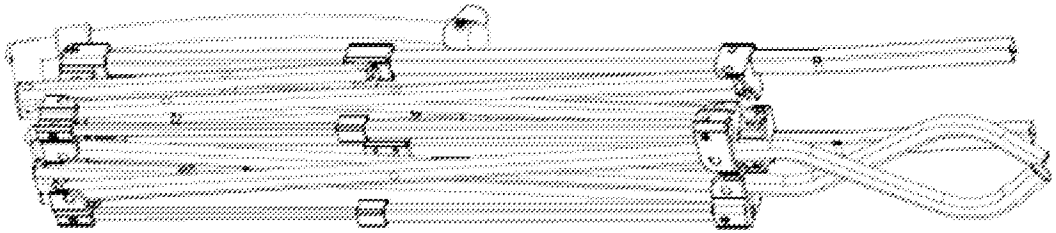
FIG. 14 is a perspective view illustrating the exemplary frame of FIG. 10 in a folded state.

Frame 300 is easy to fold and unfold. For instance, as a non-limiting example, to fold frame 300, one can push the front and rear supports toward one another as illustrated in FIG. 13. This will move sliders 122 along the arched members toward the front side of the frame, move connectors 352 and 353 upward along the rear supports, lengthen the front supports, and rotate other components (e.g., links, front cross members and back cross members). As a result, all components of the frame, including the rocking structures of both the left and right stands, are retracted toward one another and folded in a compact manner as illustrated in FIG. 14. To unfold frame 100, one can pull the front and rear supports away from each other. This will reverse the processes and unfold the frame. Should the frame be coupled with a chair cloth, the chair cloth can be folded and unfolded along with the frame.

Figure 15:
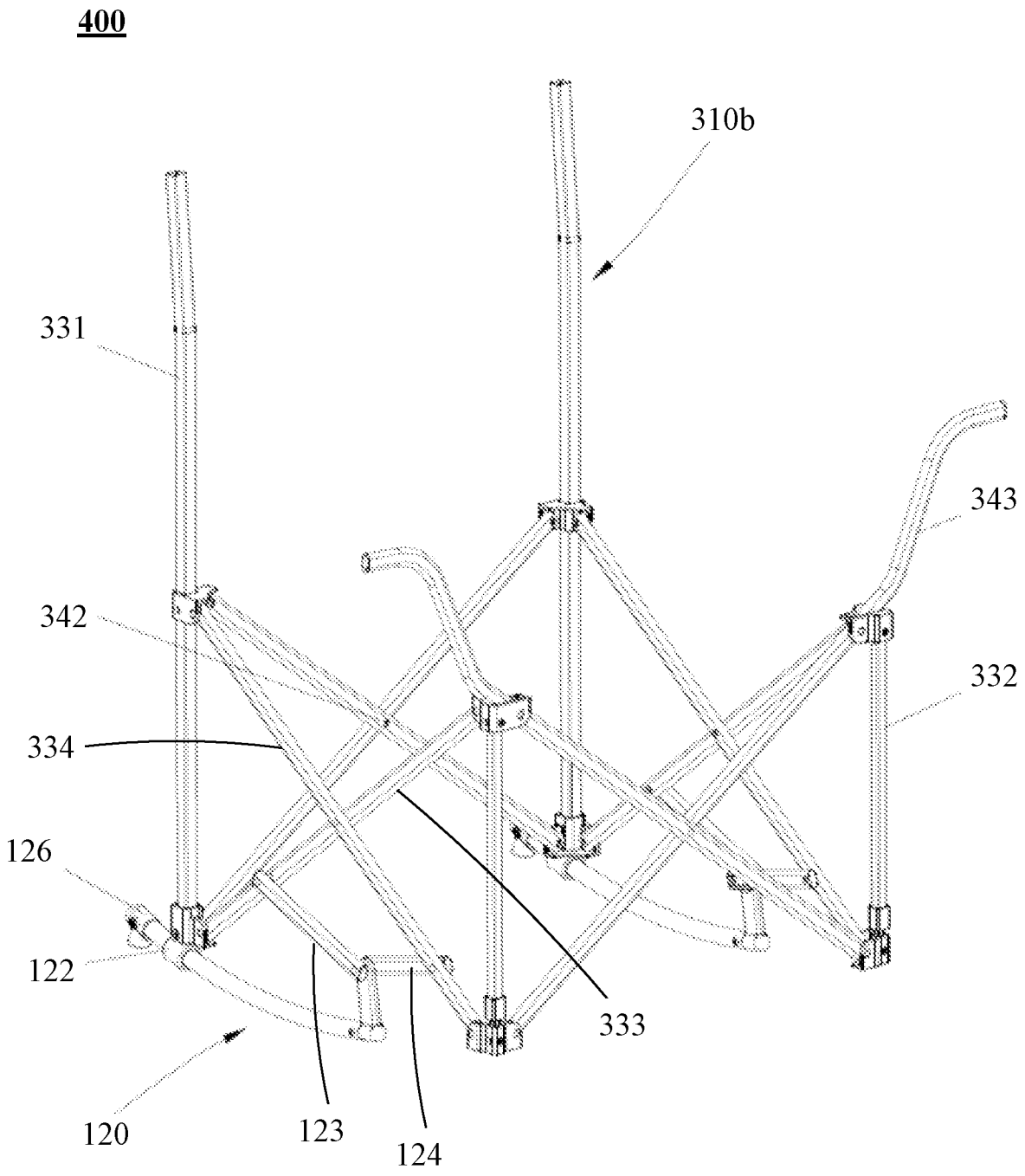
FIG. 15 is a perspective view illustrating an exemplary frame in an unfolded state in accordance with some exemplary embodiments of the present disclosure.
Figure 16:
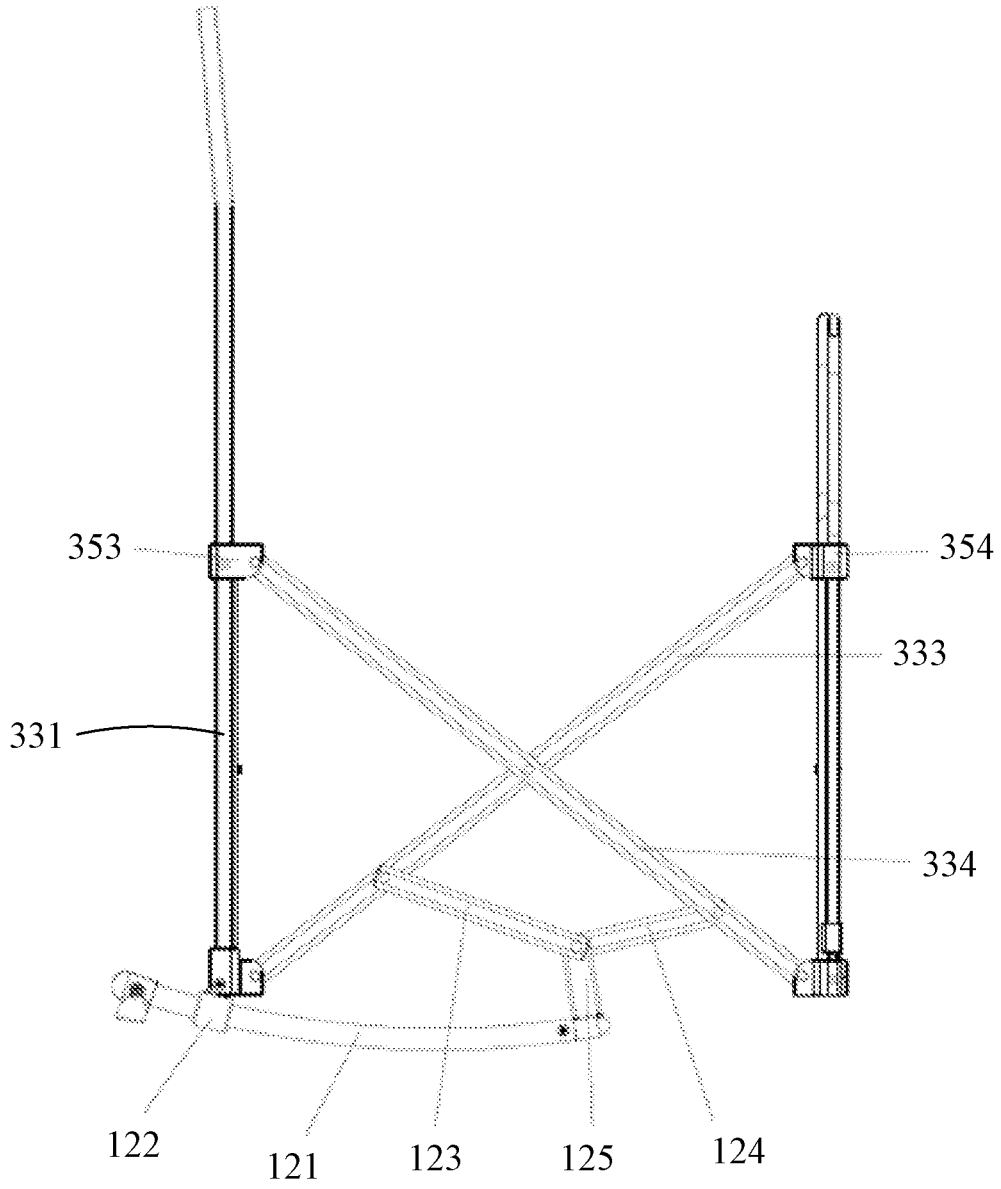
FIG. 16 is a side view illustrating the exemplary frame of FIG. 15.

Referring to FIGS. 15 and 16, there is depicted an exemplary frame 400 in accordance with some exemplary embodiments of the present disclosure. Frame 400 is substantially the same as frame 300, except (i) frame 400 does not include connector 352 disposed at the rear support and movable along the rear support and (ii) first link 123 of the rocking structure in frame 400 is relatively short and does not pivotally connected to connector 352. Instead, the end portion of the first link in frame 400 is pivotally connected to the first cross support.

Figure 17:
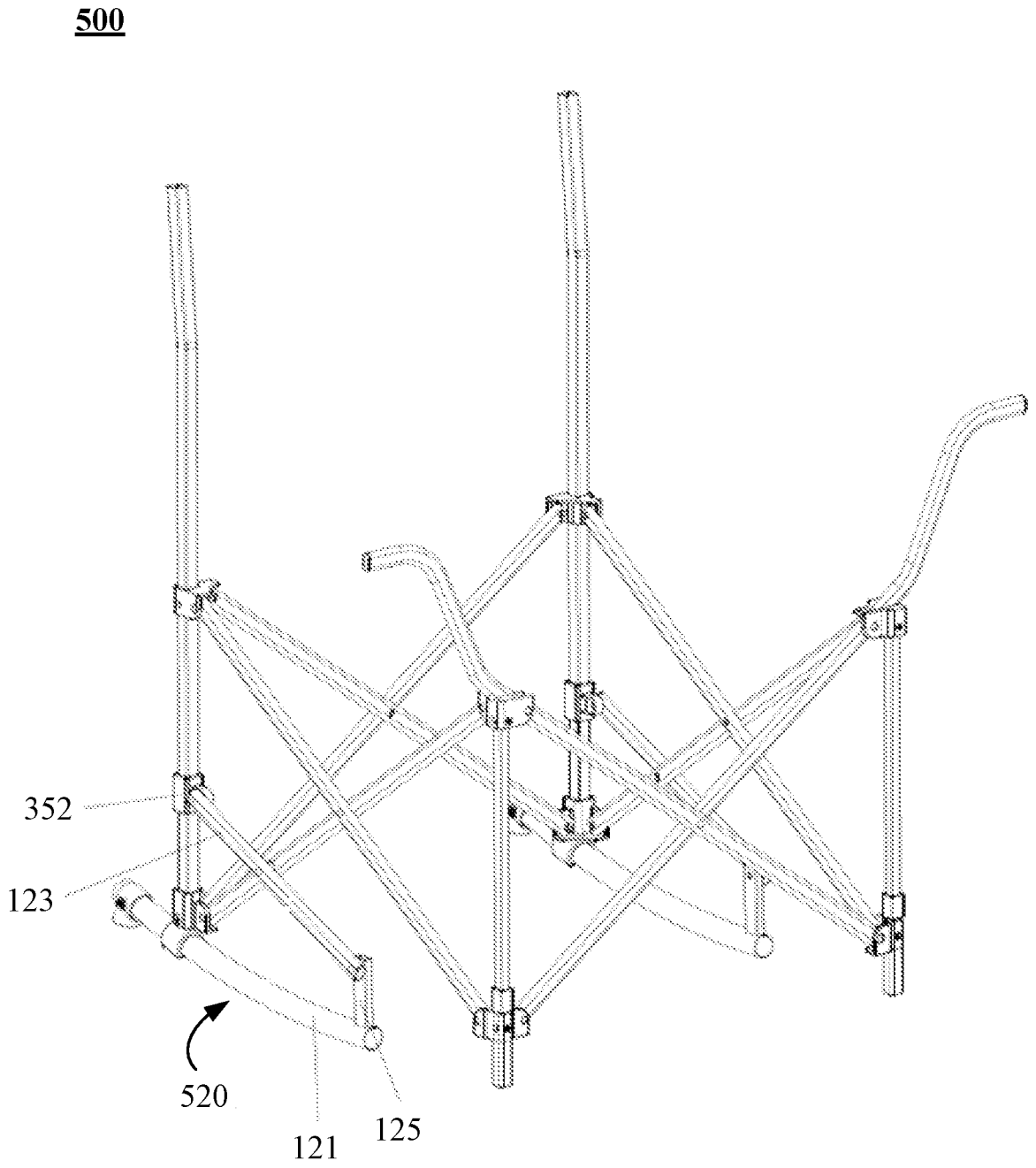
FIG. 17 is a perspective view illustrating an exemplary frame in an unfolded state in accordance with some exemplary embodiments of the present disclosure.

Referring to FIG. 17, there is depicted an exemplary frame 500 in accordance with some exemplary embodiment of the present disclosure. Frame 500 is substantially the same as frame 300, except rocking structure 520 in frame 500 does not include second link 124.

Figure 18:
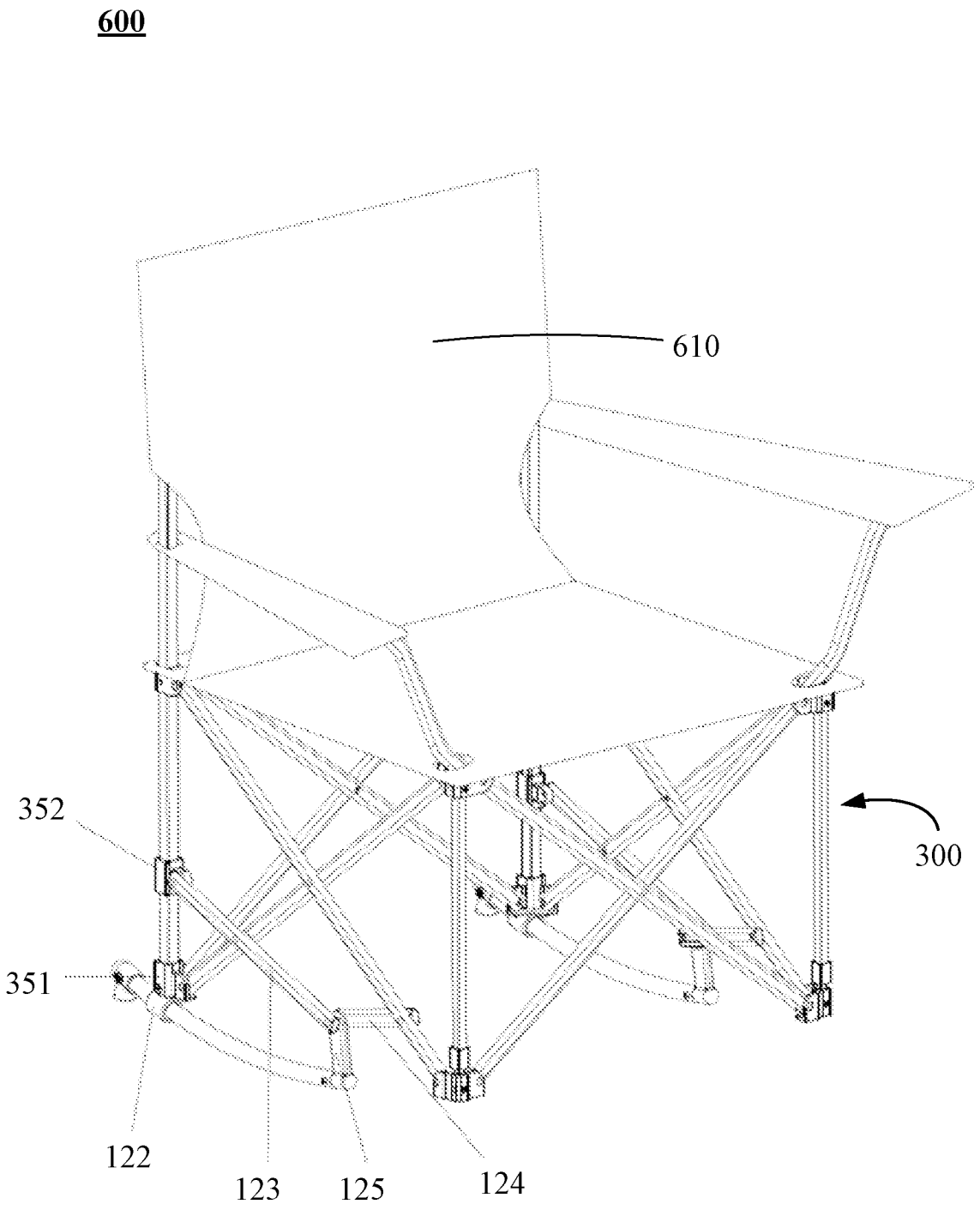
FIG. 18 is a perspective view illustrating an exemplary chair in an unfolded state in accordance with some exemplary embodiments of the present disclosure.
Figure 19:
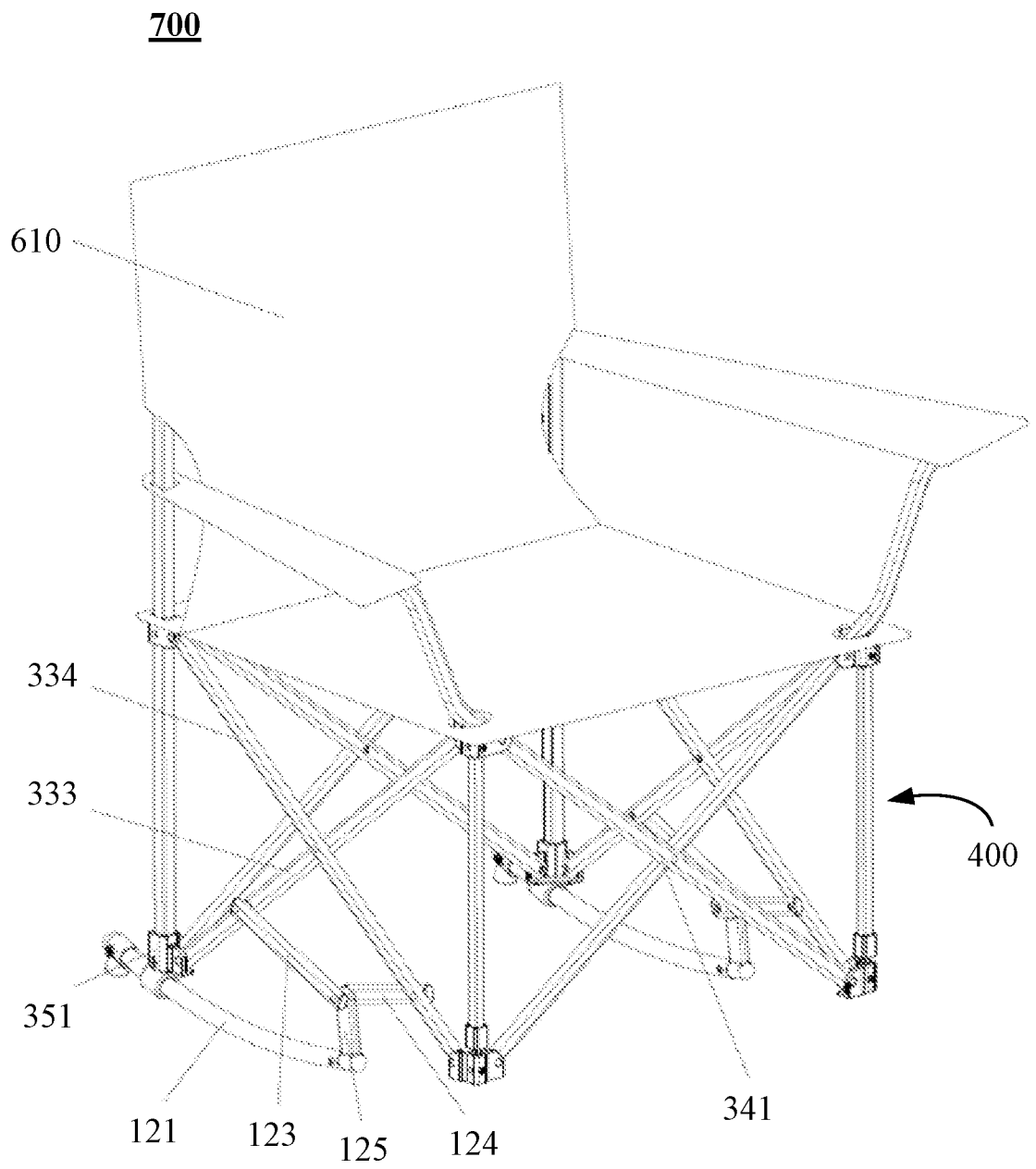
FIG. 19 is a perspective view illustrating an exemplary chair in an unfolded state in accordance with some exemplary embodiments of the present disclosure.

Any one of the frames disclosed herein can couple and support a chair cloth or the like to make a foldable rocking chair. For instance, as a non-limiting example, FIG. 18 illustrates an exemplary foldable rocking chair 600 including a chair cloth, such as chair cloth 610, coupled with frame 300 and supported by frame 300. As another non-limiting example, FIG. 19 illustrates an exemplary foldable rocking chair 700 including a chair cloth, such as chair cloth 610, coupled with frame 400 and supported by frame 400. The chair cloth can be made of any suitable material, such as fabric, textile, or the like. Moreover, the chair cloth can be made of a one-piece cloth or a number of pieces (e.g., a seat piece, a backrest piece, and/or an armrest piece) separated or combined (e.g., stitched) together.

The foldable rocking chair frames and foldable rocking chairs of the present disclosure have several advantages. For instance, they are foldable and portable, and are thus convenient for transportation and storage. Folding and unfolding of the frames and chairs are easy and simple. The frames and chairs are stable and can provide smooth or desired rocking motions. In addition, the frames and chairs have relatively simple structures and are less expensive.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "top" or "bottom", "lower" or "upper", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first portion could be termed a second portion, and, similarly, a second portion could be termed a first portion, without changing the meaning of the description, so long as all occurrences of the "first portion" are renamed consistently and all occurrences of the "second portion" are renamed consistently.

As used herein, the term "and/or" as used herein refers to and encompasses any and all possible combinations of one or more of the associated listed items. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "about" or "approximately" can mean within an acceptable error range for the particular value as determined by one of ordinary skill in the art, which can depend in part on how the value is measured or determined, e.g., the limitations of the measurement system. For example, "about" can mean within 1 or more than 1 standard deviation, per the practice in the art. "About" can mean a range of ±20%, ±10%, ±5%, or ±1% of a given value. Where particular values are described in the application and claims, unless otherwise stated, the term "about" means within an acceptable error range for the particular value. The term "about" can have the meaning as commonly understood by one of ordinary skill in the art. The term "about" can refer to ±10%. The term "about" can refer to ±5%.

What is claimed is:

1. A foldable rocking chair frame, the frame comprising:

a left side stand and a right side stand, each comprising a rocking structure and a plurality of supports, wherein:

the rocking structure and the plurality of supports are interconnected and foldable into each other;

the rocking structure comprises an arched member, a slider, and one or more links;

when the frame is unfolded, the arched member has a first end portion disposed at a rear side of the frame and extends from the rear side of the frame toward a front side of the frame;

the slider is disposed at the arched member and slidable along the arched member;

each of the one or more links has a first end portion pivotally connected to the arched member and a second end portion pivotally connected to a support in the plurality of supports;

the plurality of supports comprises a rear support; and the rear support has a lower end portion pivotally connected to the slider, and serves as a rear leg of the frame when the frame is unfolded; and a connecting assembly disposed between the left side stand and the right side stand, wherein the connecting assembly connects the left and right side stands and allows the left and right side stands to fold into each other, wherein for each of the left and right side stands, the rocking structure further comprises a post fixed or integrally formed at the second end portion of the arched member, wherein the post is positioned at an angle with respect to the second end portion of the arched member and immovable relative to the arched member, wherein the first end portion of each of the one or more links is connected to the arched member through the post.

2. The frame of claim 1, wherein for each of the left and right side stands, the rocking structure further comprises a fixing member disposed at the first end portion of the arched member to prevent the first end portion of the arched member from disengaging from the slider, to abut against a ground when the frame is unfolded, or both.

3. The frame of claim 1, wherein the angle with respect to the second end portion of the arched member is about 90 degrees.

4. The frame of claim 1, wherein for each of the left and right side stands, an upper portion of the rear support serves as a backrest support when the frame is unfolded.

5. A foldable rocking chair frame, the frame comprising:
- a left side stand and a right side stand, each comprising a rocking structure and a plurality of supports, wherein:
  - the rocking structure and the plurality of supports are interconnected and foldable into each other;
  - the rocking structure comprises an arched member, a slider, and one or more links;
  - when the frame is unfolded, the arched member has a first end portion disposed at a rear side of the frame and extends from the rear side of the frame toward a front side of the frame;
  - the slider is disposed at the arched member and slidable along the arched member;
  - each of the one or more links has a first end portion pivotally connected to the arched member and a second end portion pivotally connected to a support in the plurality of supports;
  - the plurality of supports comprises a rear support; and
  - the rear support has a lower end portion pivotally connected to the slider, and serves as a rear leg of the frame when the frame is unfolded; and
- a connecting assembly disposed between the left side stand and the right side stand, wherein the connecting assembly connects the left and right side stands and allows the left and right side stands to fold into each other, wherein for each of the left and right side stands,
- the plurality of supports further comprises a front support, wherein when the frame is unfolded, the front support serves as a front leg of the frame, is inclined backward, and abuts against an upper end portion of the rear support; and
- the one or more links comprises a first link and a second link, wherein the second end portion of the first link is pivotally connected to the rear support and the second end portion of the second link is pivotally connected to the front support.

6. The frame of claim 5, wherein for each of the left and right side stands, the plurality of supports further comprises:
- a linking support having a first end portion pivotally connected to the upper end portion of the rear support and a second end portion pivotally connected to the front support.

7. The frame of claim 5, wherein for each of the left and right side stands, the plurality of supports further comprises:
- a seating support having a rear end portion pivotally connected to the rear support and a middle portion pivotally connected to the front support.

8. The frame of claim 5, wherein for each of the left and right side stands, the plurality of supports further comprises:
- a backrest support having a lower end portion pivotally connected to the rear support, wherein an upper end portion of the front support is pivotally connected to a first connector that is disposed at the backrest support and movable along the backrest support.

9. The frame of claim 5, wherein for each of the left and right side stands, the plurality of supports further comprises:
- a seating support having a rear end portion pivotally connected to the rear support and a middle portion pivotally connected to the front support; and
- a backrest support having a lower end portion pivotally connected to the rear support, wherein an upper end portion of the front support is pivotally connected to a first connector that is disposed at the backrest support and movable along the backrest support.

10. The frame of claim 9, wherein for each of the left and right side stands, the plurality of supports further comprises:
- an upright support having a lower end portion pivotally connected to a second connector that is disposed at the front support and a middle portion pivotally connected to the seating support; and
- an armrest support having a rear end portion pivotally connected to the backrest below the first connector and a front end portion pivotally connected to an upper end portion of the upright support.

11. The frame of claim 10, wherein the connecting assembly comprises:
- a pair of front cross members pivotally connected to each other at middle portions thereof, wherein one front cross member has a lower end portion pivotally connected to the front support of the left side stand and an upper end portion pivotally connected to the seating support of the right side stand, and the other front cross member has a lower end portion pivotally connected to the front support of the right side stand and an upper end portion pivotally connected to the seating support of the left side stand; and
- a pair of rear cross members pivotally connected to each other at middle portions thereof, wherein one rear cross member has a lower end portion pivotally connected to the rear support of the left side stand and an upper end portion pivotally connected to the first connector at the backrest support of the right side stand, and the other rear cross member has a lower end portion pivotally connected to the rear support of the right side stand and an upper end portion pivotally connected to the first connector at the backrest support of the left side stand.

12. The frame of claim 11, further comprising:
- a first strengthening member having a first end portion pivotally connected to the pair of front cross members and a second end portion pivotally connected to the first link of the rocking structure of the left side stand; and
- a second strengthening member having a first end portion pivotally connected to the pair of front cross members, and a second end portion pivotally connected to the first link of the rocking structure of the right side stand.

13. The frame of claim 5, wherein for each of the left and right side stands, the rocking structure further comprises a post fixed or integrally formed at the second end portion of the arched member, wherein the post is positioned at an angle with respect to the second end portion of the arched member and immovable relative to the arched member, wherein the first end portion of each of the first and second links is connected to the arched member through the post.

14. A foldable rocking chair frame, the frame comprising:
- a left side stand and a right side stand, each comprising a rocking structure and a plurality of supports, wherein:
  - the rocking structure and the plurality of supports are interconnected and foldable into each other;
  - the rocking structure comprises an arched member, a slider, and one or more links;

when the frame is unfolded, the arched member has a first end portion disposed at a rear side of the frame and extends from the rear side of the frame toward a front side of the frame;

the slider is disposed at the arched member and slidable along the arched member;

each of the one or more links has a first end portion pivotally connected to the arched member and a second end portion pivotally connected to a support in the plurality of supports;

the plurality of supports comprises a rear support; and the rear support has a lower end portion pivotally connected to the slider, and serves as a rear leg of the frame when the frame is unfolded; and a connecting assembly disposed between the left side stand and the right side stand, wherein the connecting assembly connects the left and right side stands and allows the left and right side stands to fold into each other, wherein for each of the left and right side stands, the plurality of supports further comprises a front support, a first cross support and a second cross support, wherein the front support has a length that is adjustable;

the first and second cross supports are pivotally connected to each other at middle portions thereof;

the first cross support has a lower end portion pivotally connected to the lower end portion of the rear support, and an upper end portion pivotally connected to an upper portion of the front support; and the second cross support has a lower end portion pivotally connected to a lower end portion of the front support, and an upper end portion pivotally connected to a first connector disposed at the rear support and movable along the rear support.

15. The frame of claim 14, wherein the one or more links comprise:

a first link having the second end portion pivotally connected to the first cross support; and a second link having the second end portion pivotally connected to the second cross support.

16. The frame of claim 14, wherein the one or more links comprise:

a first link having the second end portion pivotally connected to a second connector disposed at the rear support below the first connector and movable along the rear support, and a middle portion pivotally connected to the first cross support.

17. The frame of claim 14, wherein the one or more links comprise:

a first link having the second end portion pivotally connected to a second connector disposed at the rear support below the first connector and movable along the rear support, and a middle portion pivotally connected to the first cross support; and a second link having the second end portion pivotally connected to the second cross support.

18. The frame of claim 14, wherein the connecting assembly comprises:

a pair of front cross members pivotally connected to each other at middle portions thereof, wherein each of the front cross members has a lower end portion pivotally connected to a lower end portion of the front support of one of the left and right side stands, and an upper portion slidably coupled with a third connector disposed at an upper end portion of the front support of the other of the left and right side stands; and a pair of rear cross members pivotally connected to each other at middle portions thereof, wherein each of the rear cross members has a lower end portion pivotally connected to a lower end portion of the rear support of one of the left and right side stands, and an upper end portion pivotally connected to the first connector disposed at the rear support of the other of the left and right side stands.

19. The frame of claim 18, wherein the upper portion of each of the front cross members extends upward and outward beyond the third connector when the frame is unfolded.

20. The frame of claim 14, wherein for each of the left and right side stands, the rocking structure further comprises a post fixed or integrally formed at the second end portion of the arched member, wherein the post is positioned at an angle with respect to the second end portion of the arched member and immovable relative to the arched member, wherein the first end portion of each of the one or more links is connected to the arched member through the post.

* * * * *